US009576458B2

(12) United States Patent
Calvert

(10) Patent No.: US 9,576,458 B2
(45) Date of Patent: Feb. 21, 2017

(54) ASPIRATING SMOKE DETECTORS

(71) Applicant: PROTEC FIRE DETECTION PLC, Nelson, Lancashire (GB)

(72) Inventor: Michael Andrew Calvert, Blackburn (GB)

(73) Assignee: PROTEC FIRE DETECTION PLC, Lancashire (GB)

( * ) Notice: Subject to any disclaimer, the term of this patent is extended or adjusted under 35 U.S.C. 154(b) by 0 days.

(21) Appl. No.: 14/889,014

(22) PCT Filed: Apr. 23, 2014

(86) PCT No.: PCT/GB2014/051255

§ 371 (c)(1),
(2) Date: Nov. 4, 2015

(87) PCT Pub. No.: WO2014/181082

PCT Pub. Date: Nov. 13, 2014

(65) Prior Publication Data

US 2016/0086468 A1 Mar. 24, 2016

(30) Foreign Application Priority Data

May 4, 2013 (GB) ..... 1308103.9

(51) Int. Cl.

| | |
|---|---|
| ***G08B 17/10*** | (2006.01) |
| ***G08B 29/18*** | (2006.01) |
| *G08B 1/00* | (2006.01) |
| *G08B 17/113* | (2006.01) |

(52) U.S. Cl.

CPC ..... *G08B 17/10* (2013.01); *G08B 29/188* (2013.01); *G08B 1/00* (2013.01); *G08B 17/113* (2013.01)

(58) Field of Classification Search

CPC ..... G08B 1/00; F24F 1/00

See application file for complete search history.

(56) References Cited

U.S. PATENT DOCUMENTS 4,053,776 A * 10/1977 Hertzberg ..... G08B 17/11 250/382
4,254,414 A 3/1981 Street et al.
4,764,758 A 8/1988 Skala
(Continued)

FOREIGN PATENT DOCUMENTS

CN 2887350 Y 4/2007
CN 101727727 A 6/2010
(Continued)

OTHER PUBLICATIONS

International Search Report and Written Opinion for PCT/GB2014/051255, mailed Aug. 11, 2014 (10 pages).
(Continued)

*Primary Examiner* — Shirley Lu
(74) *Attorney, Agent, or Firm* — Hoffman Warnick LLC

(57) ABSTRACT

Improvements in and Relating to Aspirating Smoke Detectors Disclosed is an aspirating smoke detection system comprising: at least two different types of detector; and a processor operable to receive signals from the at least two different types of detector, and to determine an alarm status, wherein the alarm status is one of: an all clear status; a critical status; and a status intermediate between the all clear status and the critical status.

5 Claims, 3 Drawing Sheets

(56) References Cited

U.S. PATENT DOCUMENTS

| | | | | |
|---|---|---|---|---|
| 2004/0257235 | A1 | 12/2004 | Right et al. | |
| 2011/0298623 | A1* | 12/2011 | Lenkeit ..... | G08B 17/117<br>340/628 |
| 2012/0133518 | A1 | 5/2012 | Russwurm et al. | |

FOREIGN PATENT DOCUMENTS

| | | | |
|---|---|---|---|
| DE | 2554224 | A1 | 6/1977 |
| EP | 1006500 | A2 | 6/2000 |
| JP | H0444195 | A | 2/1992 |
| JP | H07334780 | A | 12/1995 |
| WO | 02095705 | A1 | 11/2002 |
| WO | 2007135423 | A1 | 11/2007 |

OTHER PUBLICATIONS

Search Report for Patent Application No. GB1308103.9, dated Oct. 10, 2013 (4 pages).

* cited by examiner

ASPIRATING SMOKE DETECTORS

CROSS-REFERENCE TO RELATED APPLICATIONS

This application is the US national stage of PCT/GB2014/051255, filed 23 Apr. 2014, which claims priority to British Patent Application No. GB1308103.9, filed 4 May 2013, each of which is incorporated herein as though fully set forth.

The present invention relates to aspirating smoke/fire detectors and/or systems. It particularly concerns smoke/fire detectors and/or systems of an aspirating type comprising a plurality of detectors.

It is known that various types of smoke/fire detectors (henceforth referred to as smoke detectors) such as a Carbon Monoxide (CO) detector, a light scattering detector, a cloud chamber detector, a laser smoke detector, a temperature detector, and others can be used to detect smoke/fire by detecting presence of a certain particle or molecule in the air or to detect a high temperature associated with fire.

Each of these detectors is specifically designed, manufactured, and/or programmed to be sensitive to a combustion product, such as the presence of a certain type and/or size range of particles and/or molecules in the air, whereby it detects and alerts a user of a possibility of there being a smoke/fire. The specific nature of this combustion product and sensitivity of each detector thereto can, at one extreme, lead to false detections and/or, at the other extreme, non-detection of a smoke/fire which can potentially be dangerous.

Further, depending of the type of fire causing the presence of the combustion product in the air, the nature and type of combustion product may differ. For example, smoke from a smouldering fire tends to produce larger particles in the air since the majority of the smoke takes the form of condensed vapours. In contrast, smoke from a flaming fire tends to produce relatively smaller particles in the air. Therefore, by being able to determine which type of combustion product is present in the air, the user may be able to determine which type the fire is, and thereby perhaps even assess the level of danger associated therewith.

Whilst it may be possible to install a plurality of different types of these smoke detectors in a particular site and wait for each detector to detect and alert the user of any detections so that a presence of a smoke/fire can be detected, this approach to fire detection is impractical since if such an arrangement of multiple installations were used, it would be difficult, if not impossible, for the user to recognise which detector might be sensitive to which combustion product and which combination of detected combustion products is likely to indicate a higher likelihood of there being a fire and/or the type of the fire.

There is therefore a desire to provide an aspirating smoke detection system comprising more than one type of detector wherein a process is provided to process any detection arising therefrom so that any false detections of a fire can be discriminated and/or the possibility of a non-detection of a fire is minimised, and an appropriate alert issued to the user if a fire is determined to be present.

Embodiments of the present invention aim to address shortcomings in the prior art whether mentioned herein or not.

According to an aspect of the present invention, there is provided an aspirating smoke detection system comprising: at least two different types of detector; and a processor operable to receive signals from the at least two different types of detector, and to determine an alarm status, wherein the alarm status is one of: an all clear status; a critical status; and a status intermediate between the all clear status and the critical status.

Preferably, the at least two different types of detector comprise at least two detectors selected from: a Carbon Monoxide detector; a Carbon Dioxide detector; a light scattering detector; a cloud chamber detector; a laser smoke detector; and a temperature detector Preferably, the at least two types of detector comprise a Carbon Monoxide detector.

Preferably, the at least two types of detector comprise a cloud chamber smoke detector.

Preferably, the system comprises three different types of detector.

Preferably, the processor is operable to determine an alarm status according to a predefined rule, wherein said predefined rule is defined in terms of the signals received from the at least two different types of detector.

Preferably, the system comprises a single airflow path with the at least two types of detector arranged in series along the airflow path.

According to another aspect of the present invention, there is provided an aspirating smoke detection system comprising: at least two different types of detector; and a processor operable to receive signals from the at least two different types of detector, wherein one of the at least two different types of detector is provided to increase a confidence level in the determination of an alarm status.

According to another aspect of the present invention, there is provided an aspirating smoke detection system comprising: three different types of detector; and a processor operable to receive signals from the three different types of detector, wherein the processor is operable to determine an alarm status according to a predefined rule, defined in terms of the signals received from the at least two different types of detector.

Other features of the invention will be apparent from the dependent claims, and the description which follows.

For a better understanding of the invention, and to show how embodiments of the same may be carried into effect, reference will now be made, by way of example, to the accompanying diagrammatic drawings in which.

Figure 1:
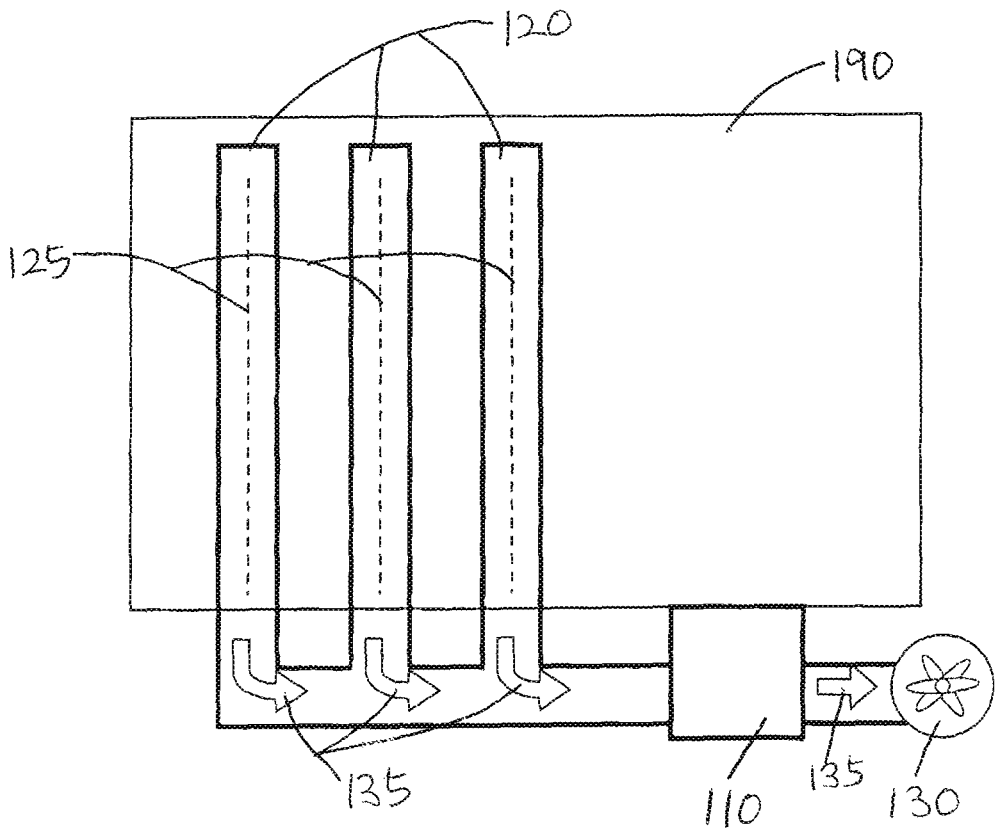
FIG. 1 shows an aspirating smoke detection system comprising an aspirating smoke detector, a fan, and a sampling pipe according to an embodiment of the invention.

FIG. 1 shows an aspirating smoke detection system comprising an aspirating smoke detector 110, a fan 130, and a sampling pipe 120 according to an embodiment of the invention. The aspirating smoke detection system comprises a plurality of sampling pipes 120 installed in a protected area 190, whereby a combustion product from a fire inside the protected area 190 can be transported to the aspirating smoke detector 110 through the network of sampling pipes 120.

The fan 130 provides an air flow 135 so that the air in the protected area 190 is drawn into the sampling pipes 120 whereby, in the event of a fire, a combustion product in the air from the protected area 190 is transported to the aspirating smoke detector 110. The sampling pipes 120 comprise a plurality of perforations 125 so that a sample of the air inside the protected area 190 and the combustion product therein can enter an inner cavity of the sampling pipes 120 and be transported by the air flow 135 to the aspirating smoke detector 110.

The aspirating smoke detector 110 is then able to detect the combustion product in the air from the protected area 190. The sampled air is then passed through a high sensitivity precision detector that analyses the air and generates warning signals when appropriate.

Figure 2:
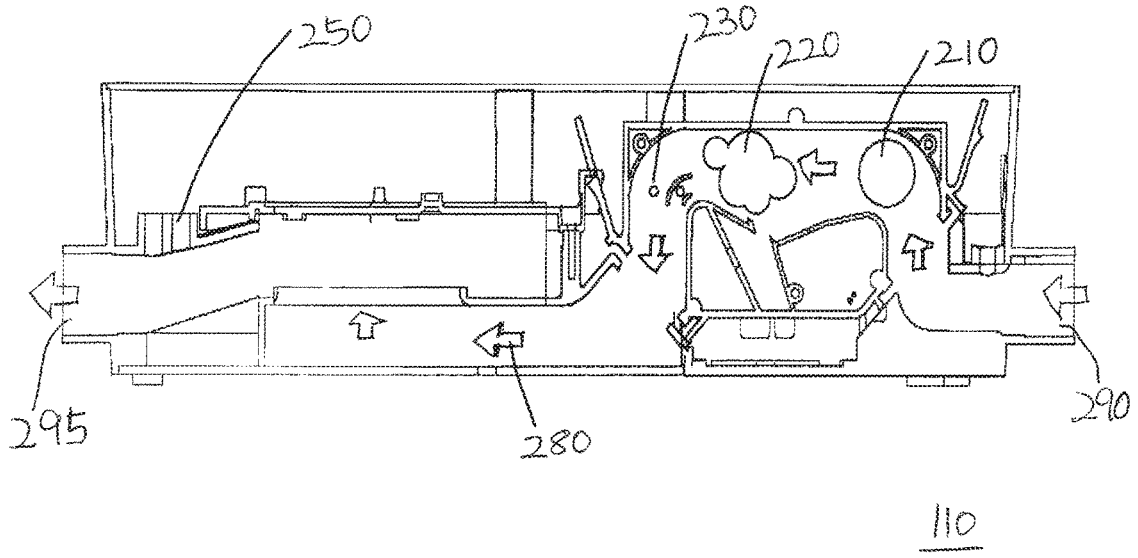
FIG. 2 shows an aspirating smoke detector comprising a CO detector, a light scattering detector and a cloud chamber according to an embodiment of the invention.

FIG. 2 shows an aspirating smoke detector 110 comprising a Carbon Monoxide (CO) detector 210, a light scattering detector 220 and a cloud chamber 250 according to an embodiment of the invention.

The detector 110 is of unitary construction and features a single path for airflow 280, such that the air which flows through the detector arrives at each type of detector in turn. In other words, the detectors are arranged in series, rather than in parallel.

The sampled air from the protected area 190 is drawn into the aspirating smoke detector 110 through its inlet 290 and the air flow 280 inside the aspirating smoke detector 110 follows a path of: an inlet 290->a CO detector 210->a light scattering detector 220->an air flow monitor 230->a cloud chamber 250->an air outlet 295. The sampled air is drawn into the aspirating smoke detector 110 by the fan 130 through the inlet 290, then the sampled air passes through different types of detectors so that any particles (combustion products) in the sampled air can be detected, and the sampled air is then exhausted through the air outlet 295. The exhausted air may be ventilated from the aspirating smoke detector 110 back to the protected area 190 using a return pipe or, alternatively, be vented to the outside.

The air flow monitor 230 monitors the air flow in the aspirating smoke detector 110 so that the air flow therein is regulated to be at an acceptable level. It is understood that the acceptable level will depend on the type of detectors used in the aspirating smoke detector 110 and the absolute level or range of acceptable values imposed by the detection requirements thereof. According to an embodiment, the air flow monitor 230 can also send a signal out so that the alert status of the whole system/detector alerts the user of the air flow monitor's 230 monitored value, for example alerting the user of unreliable detection results when the air flow monitor 230 monitors the air flow rate to be too low and/or high for the detection results from the detectors in the aspirating smoke detector 110 to be reliable.

It is understood that depending on the specific embodiment of the present invention, the path, and hence the order in which the air flows through different detector types, may be varied to achieve the desired effect. It is also understood that a filter may be used at any stage of the path to filter out any undesirable matter in the sampled air, for example sand, hair or any matter capable of resulting in a false detection, before the sampled air reaches the respectively sensitive detector so that the chances of false detections are kept to a minimum.

Any filter introduced at the input 290 of the detector 110 should, of course, not filter out any combustion products, but may be arranged to filter out any non-combustion products which could otherwise lead to false-positives.

The CO detector 210 detects presence of CO gas molecules in the air. It is understood that any other types of detector for detecting a gaseous combustion product, which is a good indicator of presence of a fire in the protected area 190, could be used instead of, or in addition to, the CO detector 210 according to an embodiment of the invention.

The light scattering detector 220, also referred to as an optical smoke detector, comprises a high-energy light source. A stream of the sampled air passes through a detection chamber wherein the high-energy light source produces pulsed light. This light is then scattered by a presence of a particle, for example a combustion product, in the sampled air.

The scattered light is then received by a solid state light receiver, so that the quantity of light received at different locations can be analysed to detect the presence of the particle in the sampled air.

The quantity of scattered light received at the solid state light receiver correlates to the amount of the particle or the combustion product in the sampled air, which in turn is indicative of the level of smoke pollution, i.e. presence of a fire.

Light scattering detectors 220 are particularly sensitive to combustion products produced by a smouldering fire and any particles produced by overloaded/overheated electrical cables. Therefore, light scattering detectors are particularly useful in situations where an early warning would be desirable. However, they can be vulnerable to dust and presence of dust can lead to various problems in their combustion product detection capabilities, for example false detections. Although a sophisticated filter and/or electronics based dust rejection method can be used to reduce such problems, such use introduces further complication to the manufacture, operation and/or maintenance of these detectors. Therefore, use of other means for discriminating against false smoke/fire detection arising from dust detection by a light scattering detector 220 would be desirable.

With regard to the cloud chambers 250, it is known that particles smaller than the wavelength of visible light are also produced when a material is overheated, say by a presence of a fire or a source of the fire. When the fire or the source of the fire causes production of such small particles, i.e. small combustion products, the number of the small particles present in the air exceeds that in a normal ambient environment. A cloud chamber 250 detector utilises the Wilson Cloud Chamber principle to detect sub-micron particles that are generated at an incipient and/or all other stages of a fire.

According to an embodiment of the invention, the sampled air is transported to a detector by a centrifugal blower whilst a portion of the sampled air is also diverted into a humidifier. At approximately 100% relative humidity, the sampled air is directed to the cloud chamber 250 where, because of temperature decrease due to a rapid vacuum expansion, water vapour condenses onto a small particle and forms a droplet. A plurality of these droplets from a cloud in the cloud chamber 250, which is then detected by a measuring system of the cloud chamber 250.

According to an embodiment of the invention, the measuring system of the cloud chamber 250 comprises a Light Emitting Diode (LED) which emits pulsed light and this pulsed light is used to count the number of the droplets formed in the cloud chamber 250. The number of these droplets is regularly measured optically using the pulsed LED, whereby the concentration of the droplets in the cloud and/or the density of the cloud can be measured. The density of the cloud is directly proportional to the number of particles present inside the cloud chamber 250.

According to an embodiment of the invention, the measuring system of the cloud chamber outputs a continuous signal that is indicative of the particle concentration/cloud density over time. This signal can then be used to provide a cascading alert status sequence with differing levels of alarm and/or warning.

The cloud chamber 250 based detectors are particularly sensitive to small particles (combustion products) released by flaming fires whilst being resistant to any undesirable false detections associated with dust, humidity, temperature change, and/or high airflow. Therefore, cloud chamber based detectors are widely used in aspirating smoke detectors (ASD) in applications where high smoke sensitivity is required, for example where the protected area 190 is a computer rooms with servers or sensitive equipment.

According to an embodiment of the invention, the aspirating smoke detector 110 comprises a particle counting detector, also known as a laser detector. In the particle counting detector, a stream of the sampled air is drawn through a focused laser beam so that the light scattered by each particle can be measured. This provides an output relative to the number of the particles present in the air that have traversed the laser beam.

Particle counting detectors are particularly sensitive to combustion products from a smouldering fire and overloaded/overheated cables but require a rigorous regulation of the air flow since their outputs are proportional to the air flow rate. Particle counting detectors are also prone to false detections arising from dust or fibres being present in the air.

Figure 3:
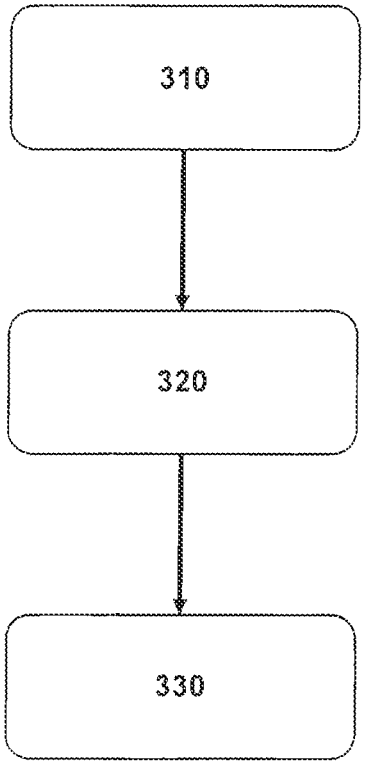
FIG. 3 shows a flowchart for performing an embodiment of the present invention.

FIG. 3 shows a flowchart of a smoke detection method for performing an embodiment of the present invention comprising the steps of a detection step 310, a processing step 320 and an alert step 330.

At the detection step 310 of the method, at least one detector, say a first detector, detects a presence of a first combustion product. Then, a determination is made as to whether any of the other detectors, say a second detector, has detected a presence of a second combustion product. Depending on the total number of the detectors, this determination will be made on the basis of detection or non-detection of a respective combustion product from each of the detectors.

According to an embodiment of the present invention, the determination is made on the basis of detection and/or non-detection results from all the detectors. According to another embodiment of the present invention, the determination is made on the basis of detection and/or non-detection results from a subset of the detectors.

It is understood that depending on the type of the combustion product, a single combustion product may be detected by more than one of the detectors. By determining which detectors have reported detection, such combustion product can be identified in the subsequent processing step 320.

It is also understood that depending on the specific embodiment, the detection step 310 may be performed over a predetermined period of time so that an ample time for each of the detectors to detect and communicate any detection or non-detection thereof can be performed within the predetermined period of time.

At the processing step, the result of the detection step 310 and detection determination therein is used to process the detection results so that the detected combustion product or type thereof present in the air is identified. Further, depending on the combustion product or combustion products identified, an alarm status, such as the strength and/or type of the fire present or a likelihood of there being a fire, is determined.

For example, the following table illustrates an exemplary detection table according to an embodiment of the present invention wherein two detectors are used:

TABLE 1

| | CO detector | Cloud chamber | Alert status |
|---|---|---|---|
| No detection or dust | 0 | 0 | Green (No alarm) |
| Small particles | 0 | 1 | Alarm |
| Incomplete combustion or large particles | 1 | 0 | Warning |
| Invisible particles | 1 | 1 | Alarm (critical) |

In the above table, a Green alarm may also be known as a "no alarm" or "all clear" status, meaning that no combustion products have been detected. A critical alarm means that there is a very strong confidence that a fire has been detected. An alarm at the level of "Warning" is intermediate between the two extreme just mentioned and may require a user to perform a visual inspection of the protected area to ensure that no smouldering fire exists.

The following table illustrates another exemplary detection table according to an embodiment of the present invention wherein three detectors are used:

TABLE 2

| | CO detector | Cloud chamber | Light scattering detector | Alert status |
|---|---|---|---|---|
| | 0 | 0 | 0 | Green (No alarm) |
| Dust | 0 | 0 | 1 | Warning |
| | 0 | 1 | 0 | Alarm |
| | 0 | 1 | 1 | Alarm |
| Incomplete combustion | 1 | 0 | 0 | Warning |
| Large particles | 1 | 0 | 1 | Warning |
| Invisible particles | 1 | 1 | 0 | Alarm |
| | 1 | 1 | 1 | Alarm (critical) |

Although the two truth tables set out above are presented in terms of a digital system, it will be understood by the skilled person that the outputs of different types of detector are likely to be analogue, producing a range of values, rather than a simple on/off as shown here for convenience. As such, the determination of the predefined rule which is used to determine the alarm status makes use of thresholds of differing values. These thresholds may be varied depending on the nature of the protected area. For instance, a warehouse may have different thresholds set up to a server room containing banks of electrical equipment. The thresholds could be so adjusted to account for a dustier environment, for instance.

If large particles are detected, a smouldering fire is likely to be present. Detection of the smouldering fire is useful since such a fire can last for a long period of time (of the order of hours), spreading slowly and silently until critical conditions are attained, at which point a flaming fire suddenly erupts. Therefore, the ability to detect the smouldering fire at an early stage can be useful in limiting any damage or loss resulting from the fire.

If small particles are detected, a flaming fire is likely to be present.

At the alert step 330, an alert is issued in accordance with the alarm status. The alert system may comprises a cascading system with each associated level indicative of the strength, type, likelihood, and/or any combination thereof of the detected fire.

Although a unitary construction is presented herein, it is understood that the smoke detection method of FIG. 3 may be stored and/or implemented on a separate processor arranged to be communicable with a plurality of detectors.

Figure 4:
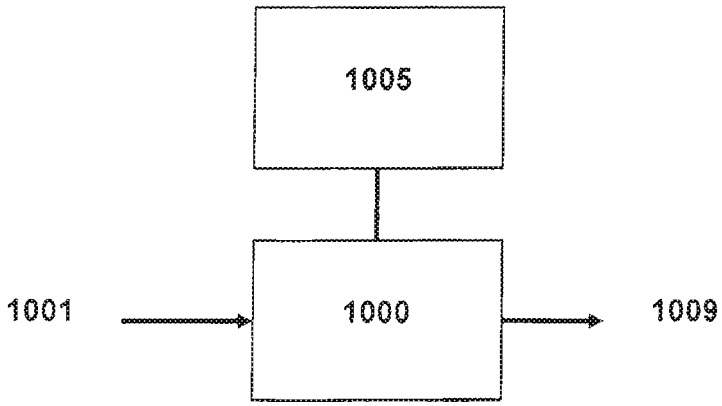
FIG. 4 shows a processor which may be configured to perform embodiments of the present invention.

FIG. 4 shows a processor which may be configured to perform embodiments of the present invention. The processor 1000 is arranged to process signals 1000 received from the different types of detector, and to produce an alarm signal 1009, depending on the predefined rule against which said detector signals are measured. The processor is provided with memory 1005, which may comprise working memory and/or storage memory, either or both of which may comprise non-volatile memory.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An aspirating smoke detection system comprising:

at least two different types of detector comprising a cloud chamber smoke detector and at least one detector selected from a group consisting of: a carbon monoxide detector, a carbon dioxide detector, a light-scattering detector, a laser smoke detector, and a temperature detector; and a processor operable to receive signals from the at least two different types of detector, and to determine an alarm status, wherein the alarm status is one of: an all clear status; a critical status; or a status intermediate between the all clear status and the critical status.

2. The aspirating smoke detection system of claim 1, wherein the at least two types of detector comprise a Carbon Monoxide detector.

3. The aspirating smoke detection system of claim 1, comprising three different types of detector.

4. The aspirating smoke detection system of claim 1 wherein the processor is operable to determine an alarm status according to a predefined rule, wherein said predefined rule is defined in terms of the signals received from the at least two different types of detector.

5. The aspirating smoke detection system of claim 1 comprising a single airflow path with the at least two types of detector arranged in series along the airflow path.

* * * * *